US010863805B1

(12) United States Patent
Cudden

(10) Patent No.: US 10,863,805 B1
(45) Date of Patent: Dec. 15, 2020

(54) REMOVABLE STORAGE POUCH ASSEMBLY

(71) Applicant: Lynne Cudden, Mesa, AZ (US)

(72) Inventor: Lynne Cudden, Mesa, AZ (US)

( * ) Notice: Subject to any disclaimer, the term of this patent is extended or adjusted under 35 U.S.C. 154(b) by 0 days.

(21) Appl. No.: 16/362,306

(22) Filed: Mar. 22, 2019

Related U.S. Application Data

(60) Provisional application No. 62/647,138, filed on Mar. 23, 2018.

(51) Int. Cl.

| | |
|---|---|
| ***A45C 3/00*** | (2006.01) |
| ***A45C 13/02*** | (2006.01) |
| ***A45C 13/10*** | (2006.01) |
| ***A45C 3/06*** | (2006.01) |
| ***A45C 1/02*** | (2006.01) |

(52) U.S. Cl.
CPC ..... *A45C 3/001* (2013.01); *A45C 1/02* (2013.01); *A45C 3/06* (2013.01); *A45C 13/02* (2013.01); *A45C 13/1092* (2013.01); *A45C 2003/002* (2013.01); *A45C 2013/026* (2013.01)

(58) Field of Classification Search
CPC .. A45C 3/001; A45C 3/06; A45C 1/02; A45C 13/02; A45C 13/1092
See application file for complete search history.

(56) References Cited

U.S. PATENT DOCUMENTS 2,179,214 A * 11/1939 Hallbauer ..... A45C 15/06 362/156
2,304,387 A * 12/1942 Whiting ..... A45C 15/06 362/156
2,611,573 A * 9/1952 Young ..... A45C 15/06 248/285.1
4,091,443 A * 5/1978 Ohrenstein ..... A45C 15/06 362/103
4,912,611 A * 3/1990 Lyle ..... A45C 15/06 362/155
4,954,934 A * 9/1990 Kidder ..... A45C 15/06 362/156
5,038,271 A * 8/1991 LoBello ..... F21L 2/00 362/116
5,444,605 A * 8/1995 Rivera ..... A45C 15/06 362/156

(Continued)

*Primary Examiner* — Anabel Ton

(74) *Attorney, Agent, or Firm* — Schmeiser, Olsen & Watts LLP

(57) ABSTRACT

A removable storage pouch includes a pouch having a closeable opening providing access to an inner volume and three pouch attachment points coupled to an exterior side of the pouch. The removable storage pouch also includes a connector assembly comprising three corresponding pouch attachment points and two surface attachment points. Further, the removable storage pouch includes a removable light assembly operatively coupled to an inner surface of the pouch within the inner volume. Two of the three pouch attachment points of the pouch and two of the corresponding attachment points of the connector assembly are coupled together to complete an electrical circuit. The removable light assembly operatively coupled to an inner surface of the pouch includes electrical connectivity and removably coupling the light assembly to the inner surface of the pouch in order to light a light source of the light assembly.

17 Claims, 10 Drawing Sheets

(56) References Cited

U.S. PATENT DOCUMENTS

| | | | | |
|---|---|---|---|---|
| 6,447,142 | B1 * | 9/2002 | Weir | A45C 15/06 150/100 |
| 6,637,909 | B1 * | 10/2003 | Bryan | A45C 15/00 362/154 |
| 7,178,936 | B2 * | 2/2007 | Lai | A45C 13/1069 362/155 |
| 8,944,628 | B2 | 2/2015 | Melamed | |
| 9,696,017 | B2 * | 7/2017 | Allen | F21V 21/088 |
| 9,814,290 | B1 * | 11/2017 | Winkler | A45C 15/06 |
| 2004/0090773 | A1 * | 5/2004 | Bryan | A45C 3/08 362/156 |
| 2009/0070967 | A1 * | 3/2009 | Gonzalez | A42B 3/044 24/16 R |
| 2013/0271964 | A1 * | 10/2013 | Rife | A44C 15/0015 362/104 |
| 2015/0164191 | A1 * | 6/2015 | Hause | A45C 3/06 150/107 |
| 2016/0261695 | A1 * | 9/2016 | Schaff | A45C 5/03 |
| 2018/0020812 | A1 * | 1/2018 | Rao | A45F 4/02 320/137 |

* cited by examiner

REMOVABLE STORAGE POUCH ASSEMBLY

CROSS REFERENCE TO RELATED APPLICATION'S

This application claims priority to U.S. Provisional Patent Application to Lynne Cudden entitled "REMOVABLE STORAGE POUCH," Ser. No. 62/647,138, filed Mar. 23, 2018, the disclosures of which are hereby incorporated entirely herein by reference.

BACKGROUND OF THE INVENTION

Technical Field

This invention relates generally to a pouch and more particularly to a removable storage pouch assembly that is attachable and detachable to another surface, such as, but not limited to, an interior surface of a bag or purse.

State of the Art

A conventional pouch for use with a bag, such as a purse, is typically placed loosely within the bag. The user then needs to search for the pouch within the bag in order to locate and utilize the pouch. The pouch is generally not readily available, making the usage of such a pouch ineffective regarding ease of access and use. Accordingly, there is a need for an improved pouch for use with a bag.

SUMMARY OF THE INVENTION

The present invention relates to removable storage pouch assembly for use with another surface, such as, but not limited to, an interior surface of a bag or purse.

An embodiment includes a removable storage pouch comprising a pouch having a closeable opening providing access to an inner volume and three pouch attachment points coupled to an exterior side of the pouch; a connector assembly comprising three corresponding pouch attachment points and two surface attachment points; and a removable light assembly operatively coupled to an inner surface of the pouch within the inner volume; wherein the two of the three pouch attachment points of the pouch and two of the corresponding attachment points of the connector assembly are coupled together to complete an electrical circuit, wherein the removable light assembly operatively coupled to an inner surface of the pouch includes electrical connectivity and removably coupling the light assembly to the inner surface of the pouch in order to light a light source of the light assembly.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
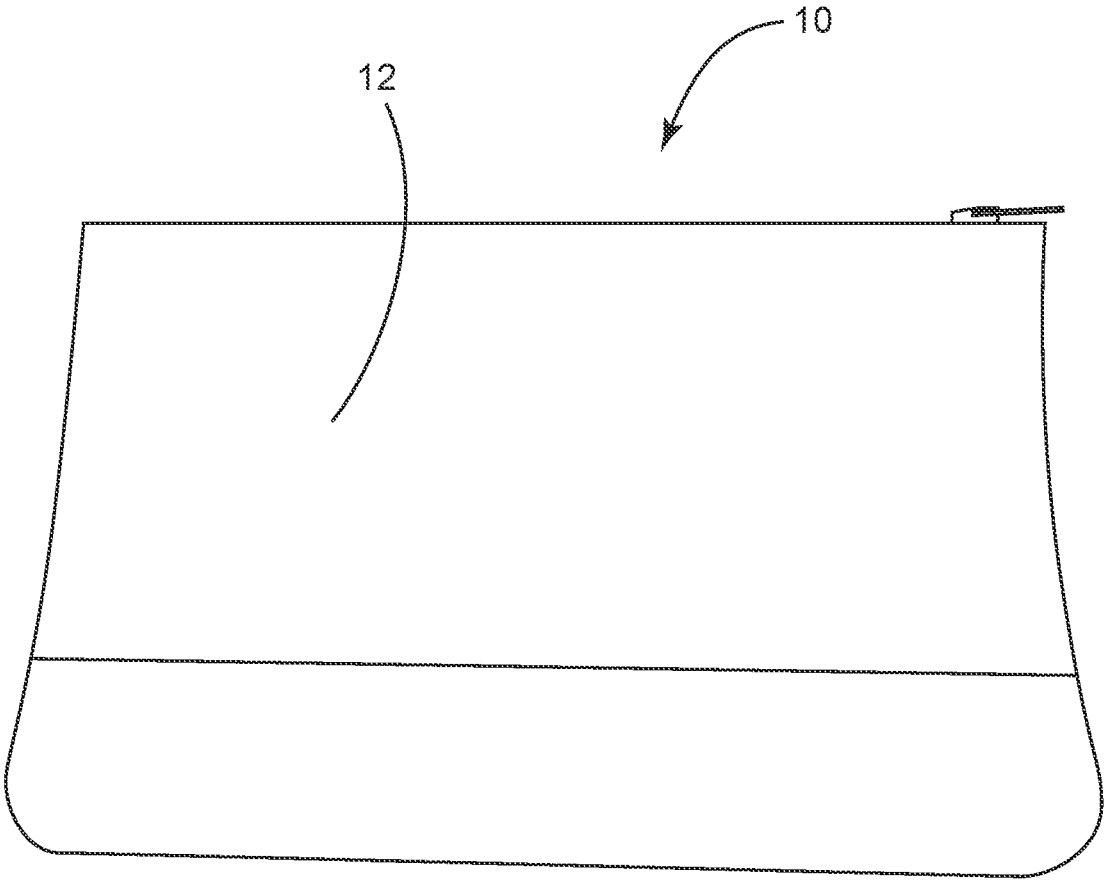
FIG. 1 is a front view of a removable storage pouch in accordance with an embodiment.
Figure 2:
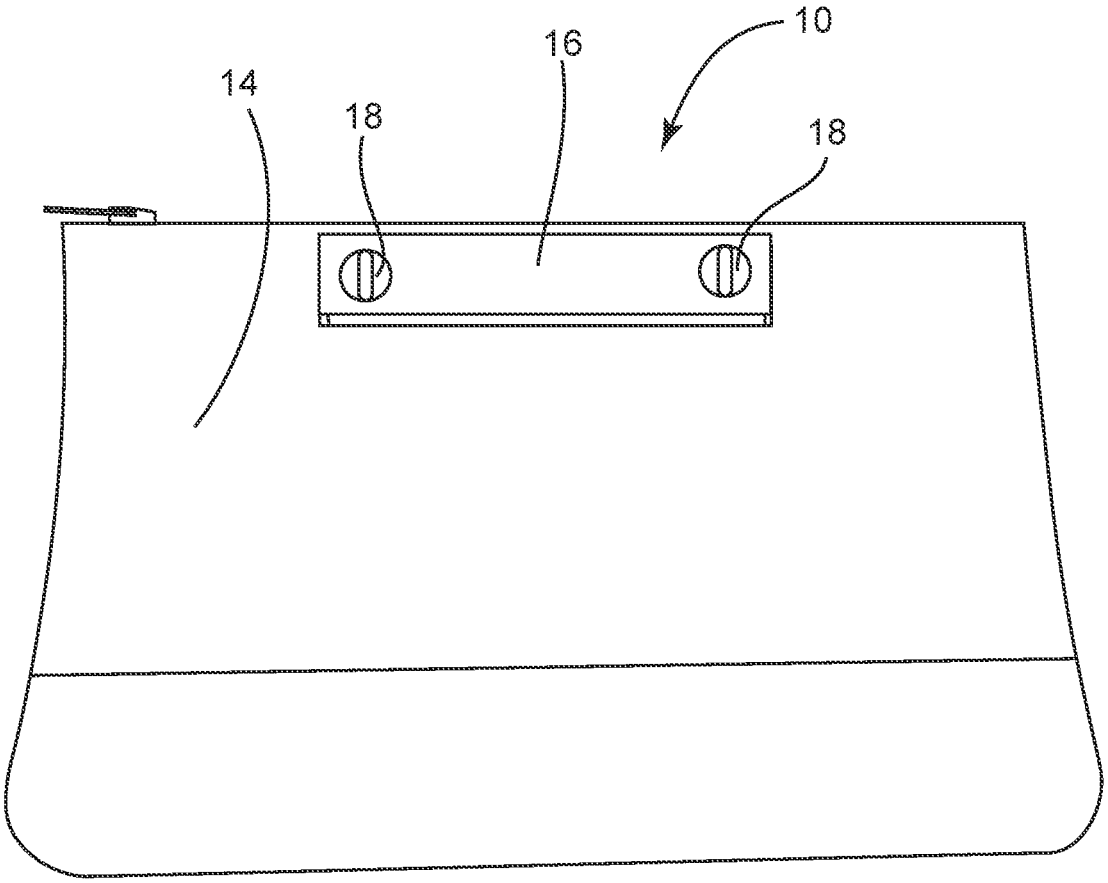
FIG. 2 is a rear view of a removable storage pouch in accordance with an embodiment.
Figure 3:
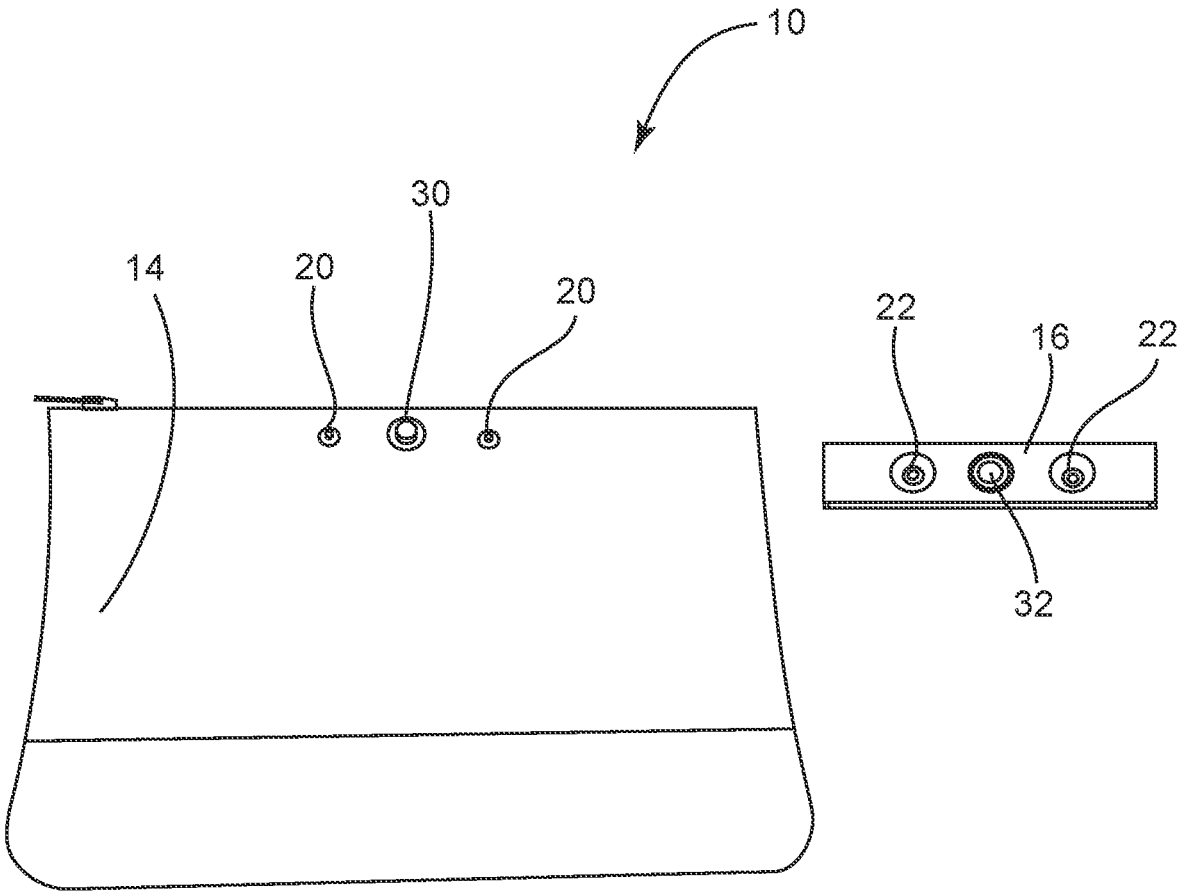
FIG. 3 is an exploded view of a removable storage pouch in accordance with an embodiment.

As discussed above, embodiments of the present invention relate to a removable storage pouch assembly with a light source. The removable storage pouch assembly is for use with another surface, such as, but not limited to, an interior surface of a bag or purse.

Referring to FIGS. 1-10, a removable pouch assembly of the present invention may include a small pouch 10, a connection member 16, and a light assembly 50. The pouch 10 comprises a front side 12, a back side 14, and a connection member 16 by which the pouch 10 may be securely connected to a surface for the purpose of adding small, convenient, removeable storage, and with the connection member 16 permitting the easy separation of the pouch from where it is connected.

The pouch 10 includes a plurality of attachment points 30 and 20 affixed by any means to a surface of the pouch, such as to the exterior of the back surface 14 of the pouch 10. In embodiments, the back surface 14 may be of a stiff material to provide support for the attachment points 30 and 20. These attachment points 30 and 20 comprise one side of a pouch joint by which the pouch 10 connects to the pouch joint on the inboard side of a connector assembly 16, on which is affixed the corresponding attachment points 32 and 22 for the pouch joint. The outboard side of the connector assembly 16 includes further attachment points 18 that comprise one side of a joint for the attachment of the connector assembly 16 and pouch to a surface, such as a bag, a purse, a case, or a pack, for example. The attachment points 18 comprising the other side of the joint are configured to be affixed to the surface to which the pouch 10 is to be attached.

With each of the above joints fully engaged, the pouch 10 is solidly affixed to a surface but can be easily removed by unsnapping the attachment points 30 and 20 of the pouch joint, thus separating the pouch 10 from the connector assembly 16 which remains securely affixed to the surface. The pouch 10 can once again be securely attached to the surface simply by re-engaging the attachment points 30 and 20 to the corresponding attachment points 32 and 22.

In an embodiment of the invention, male/female snaps 30 and 32 and 20 and 22 are used as the attachment points for the pouch joint with two of the snaps (20 and 22) composed of electrically-conductive material and forming a portion of an electrical circuit. Furthermore, within the connector assembly 16, the two attachment points 32 are connected via an electrically-conductive material, such as by electrical wire, for example. This electrical circuit additionally includes a pair of electrically conductive attachment member that comprises one side of an electrically-conductive accessory attachment joint on the interior surface of the pouch 10. The opposite conductive attachment member for the accessory attachment joint are integral components 52 and 54 of a light assembly 50, which includes any number of light sources 56 connected to a small power source (not shown). The power and light sources 56 are located within a flexible housing 51 that includes the electrically conductive attachment member 52 and 54 coupled on an end of the flexible housing 51.

Figure 4:
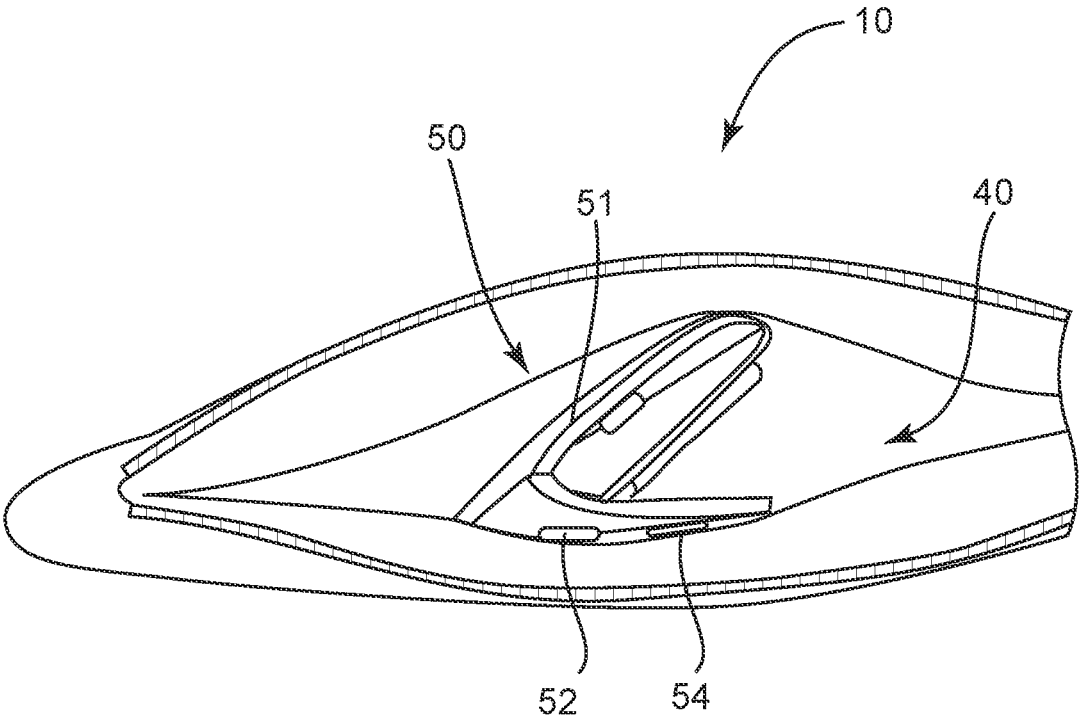
FIG. 4 is a perspective view of a removable storage pouch in an open position and light source unlit in accordance with an embodiment.
Figure 5:
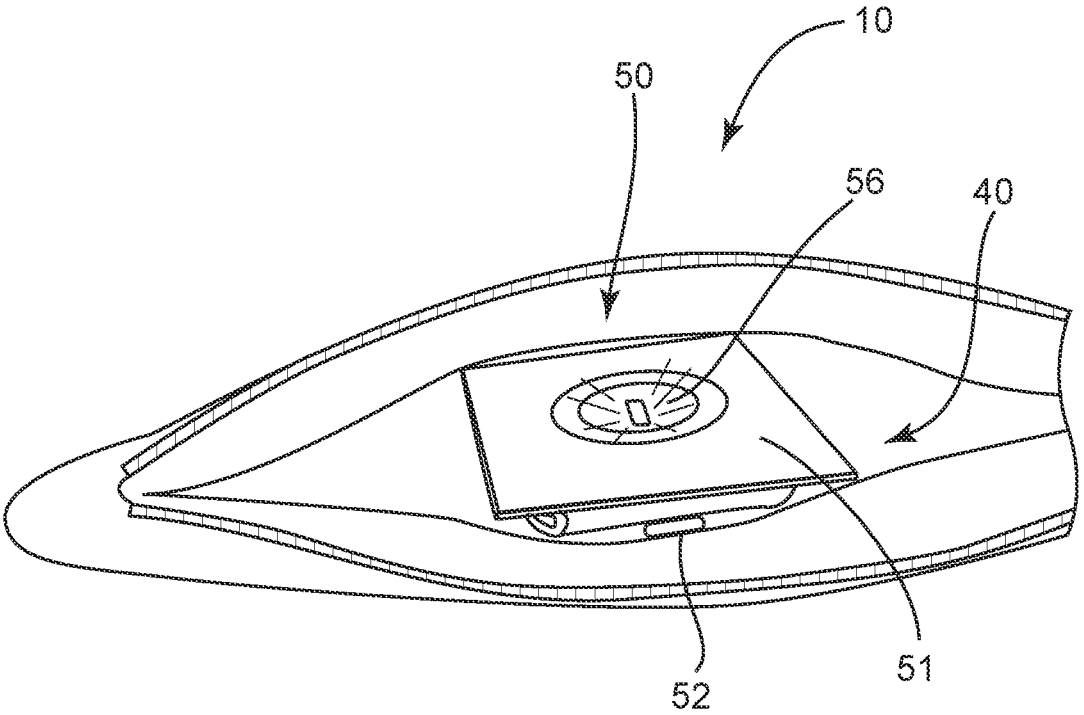
FIG. 5 is a perspective view of a removable storage pouch in an open position and light source lit in accordance with an embodiment.
Figure 6:
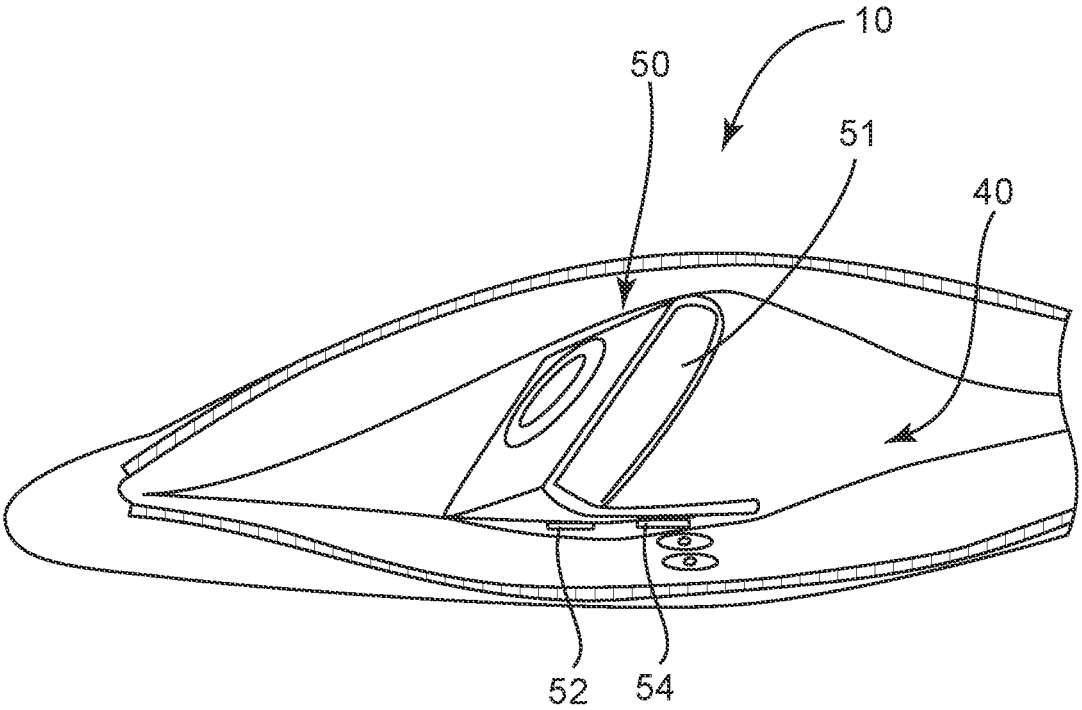
FIG. 6 is a perspective view of a removable storage pouch in an open position and light source unlit in accordance with an embodiment.
Figure 7:
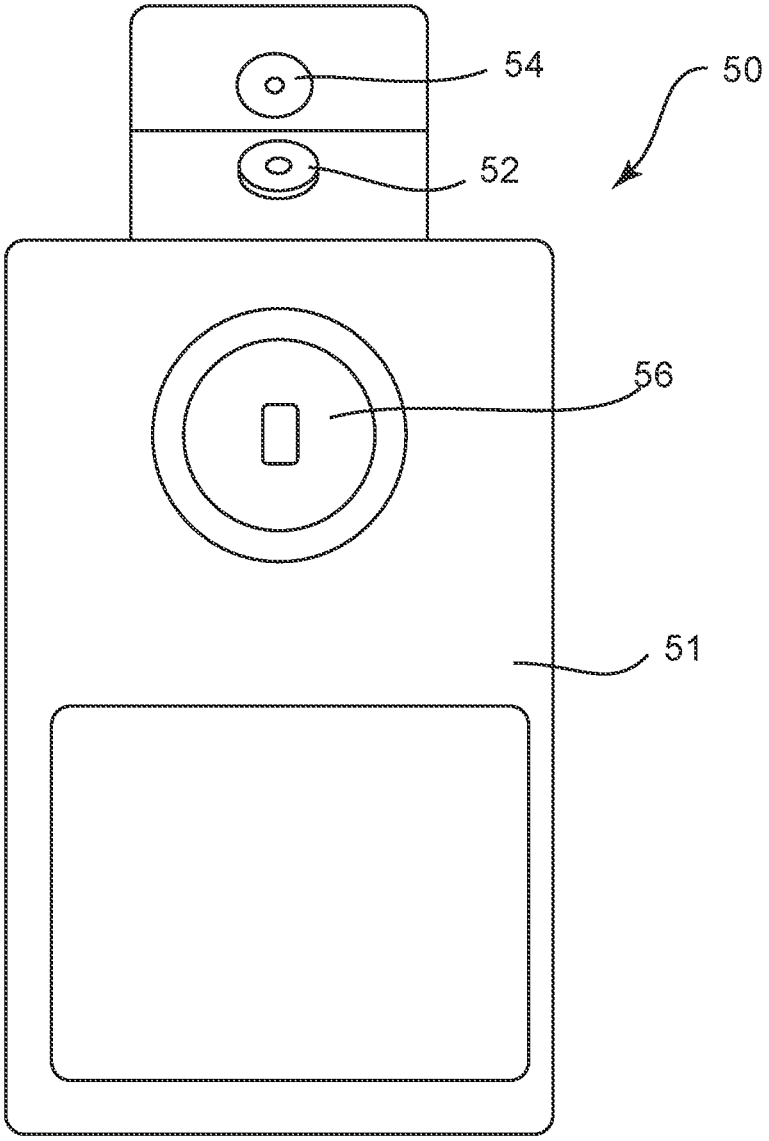
FIG. 7 is a front view of a light source unlit in accordance with an embodiment.
Figure 8:
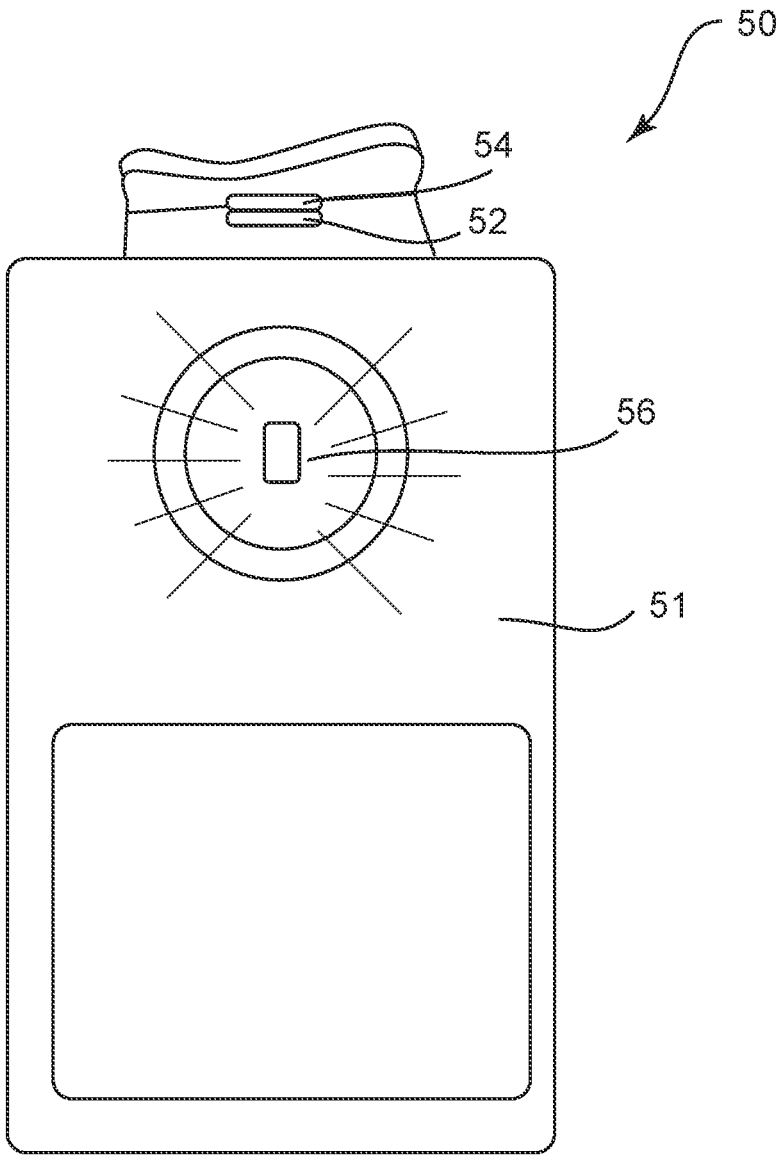
FIG. 8 is a front view of a light source lit in accordance with an embodiment.

When the pouch 10 is affixed to a surface and the light assembly 50 is connected to the pouch 10 via the accessory attachment joint an electrical circuit is formed from the power source (not shown), through the light source(s) 56, into the connector assembly via the first attachment member 52 of the accessory attachment joint, through a first set of attachment points 20 and 22, across the portion of the circuit portion in the connector assembly 16 to the second set of attachment points 22 and 20, and back to the power source via the second attachment member 54 of the accessory attachment joint. Thus, a closed circuit is formed with the light assembly 50 providing light to the pouch 10 interior and surrounding area. The flexible housing 51 can be folded within the pouch 10 as shown in FIGS. 4-6. This circuit can be broken by unfixing any of the attachment member 52 or 54 or by a switch placed at a convenient location along the electrical circuit. In additional embodiments, as shown in FIGS. 7 and 8, the first attachment member 52 may be a female attachment member and the second attachment member 54 may be male attachments that can be coupled together by folding the flexible housing to engage the first attachment member 52 with the second attachment member 54 to close a circuit and operate the light source 56 in conditions when the light assembly 50 is removed from within the pouch 10. This allows for external uses of the light assembly 50.

Figure 9:
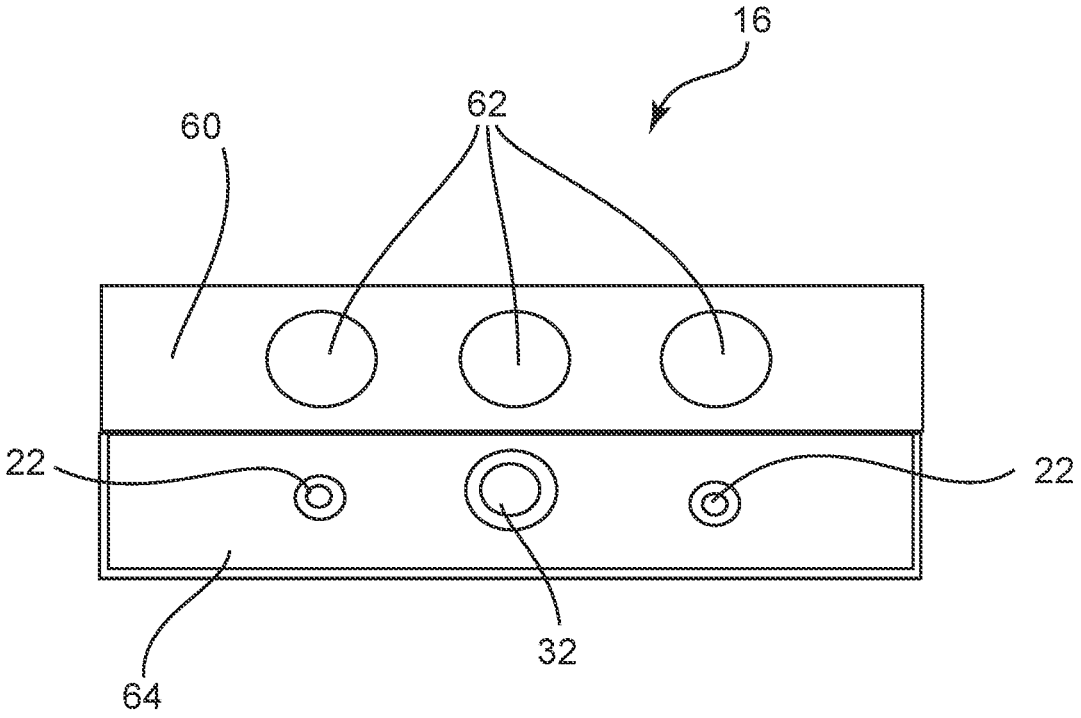
FIG. 9 is a perspective view of a connector assembly in accordance with an embodiment.
Figure 10:
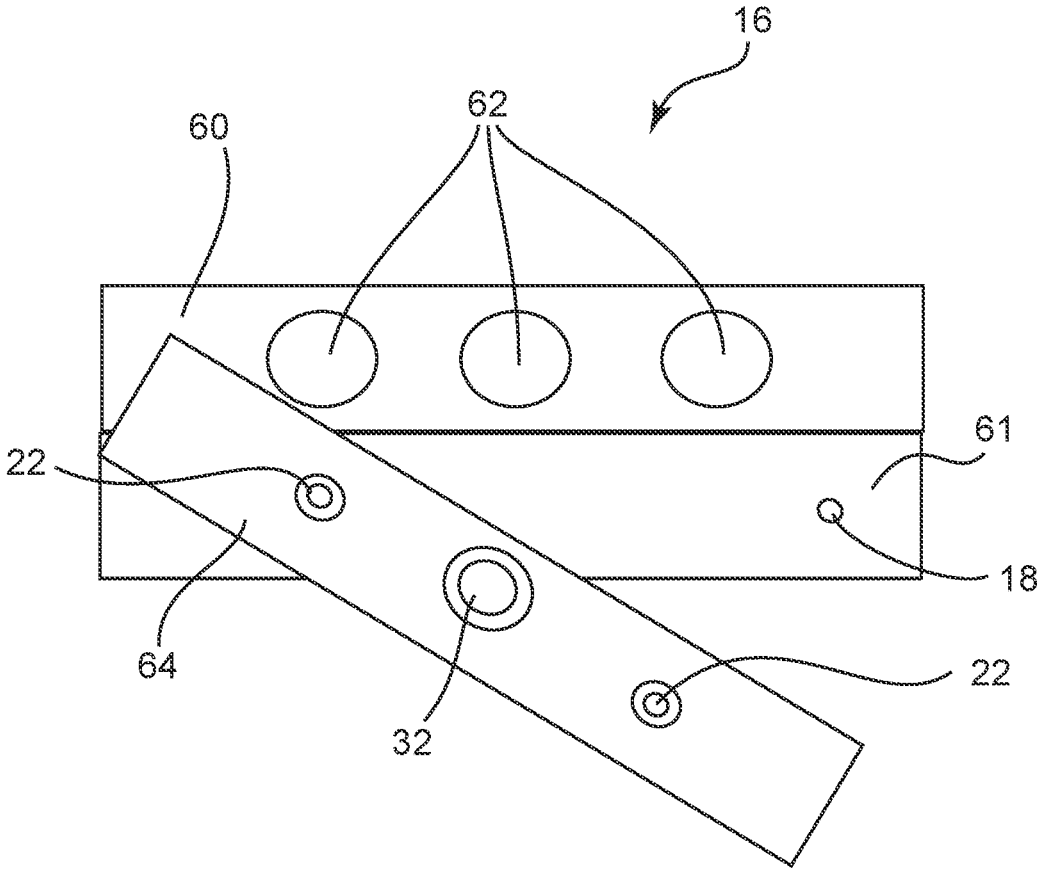
FIG. 10 is another perspective view of a connector assembly in accordance with an embodiment.

Referring specifically to FIGS. 9-10, the connector assembly 16 may include a folding member having a first portion 60 with apertures 62 extending through the first portion 60 and a second portion 61 having attachment points 18 for securing the folding member to a surface. The first portion 60 may be releasably coupled to the second portion 61 such as by use of a hook-and-loop fastener. The first portion 60 may be released and rotated away from the second portion 61 exposes and allows for removal of inner member 64, to which attachment points 32 and 22 are coupled to the inner member 64. The attachment points 32 and 22 are coupled to the inner member 64 in a position corresponding to the apertures 62 of the first portion 60 such that when the first portion 60 is coupled to the second portion 61 the attachment points 32 and 22 are exposed and have the ability to be secured to a pouch 10 as described above. This allows multiple folding members to be coupled to different surfaces, such as, but not limited to, different bags and using a single inner member 64 to be utilized with the multiple folding members.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A removable pouch assembly, comprising:

a pouch, further comprising two pouch attachment points made of an electrically-conductive material and extend through the pouch to the inner volume thereof;

a connector assembly comprising two inner member attachment points made of electrically-conductive material and coupled together by an electrically-conductive material;

a light assembly comprising a power source;

at least one light electrically coupled to the power source;

a first electrically-conductive attachment member coupled to a housing, the first electrically-conductive attachment member being electrically coupled to the at least one light source; and a second electrically-conductive attachment member coupled to the housing, the second electrically-conductive attachment member being electrically coupled to the power source, wherein each of the first and second electrically-conductive attachment member is coupled to an electrically-conductive pouch attachment point within the inner volume of the pouch, respectively, thereby completing an electrical circuit illuminating the at least one light source while the housing is within the pouch.

2. The removable pouch assembly of claim 1, wherein the pouch further comprises a closeable opening that provides access to an inner volume thereof.

3. The removable pouch assembly of claim 2, wherein the connector assembly further comprises: a folding member, further comprising:

a first portion having a apertures therethrough, the apertures being equal in number to the pouch attachment points of the pouch; and a second portion foldably coupled to the first portion along an edge thereof, the second portion having the at least one mounting attachment point coupled thereto, the at least one mounting attachment point being configured to secure the folding member to a mounting surface, wherein the first portion is releasably secured in a folded configuration to the second portion by a releasably securing means; and an inner member removably secured between the first portion and the second portion while in a folded configuration such that each of the inner member attachment points corresponds to and extends through an aperture of the first portion and is removably coupled to the corresponding pouch attachment point of the pouch, respectively, wherein each of the electrically-conductive inner member attachment points is removably coupled to a corresponding electrically-conductive pouch attachment point of the pouch, respectively.

4. The removable pouch assembly of claim 3, wherein the light assembly further comprises a flexible housing retaining the power source and the at least one light source.

5. The removable pouch assembly of claim 4, wherein the at least one attachment point of the second portion of the folding member of the connector assembly is coupled to a surface of one of a purse, a bag, a case, or a pack.

6. The removable pouch assembly of claim 4, wherein the releasably securing means by which the first portion of the folding member of the connector assembly is releasably secured in a folded configuration to the second portion of the folding member of the connector assembly is a hook-and-loop fastener.

7. The removable pouch assembly of claim 4, wherein each of the plurality of pouch attachment points of the pouch, the plurality of inner member attachment points of the connector assembly, and the first and second electrically-conductive attachment member of the light assembly, is a snap fastener.

8. The removable pouch assembly of claim 4, wherein the first and second electrically-conductive attachment member of the light assembly is configured to be removably coupled together by a user, while the light assembly is detached from the pouch, thereby completing an electrical circuit illuminating the at least one light source.

9. The removable pouch assembly of claim 4, wherein the electrical circuit thereof further comprises a switch integrated therein for engaging and disengaging the electrical circuit.

10. The removable pouch assembly of claim 4, comprising at least two folding members, wherein each of the at least two folding members is coupled to a mounting surface at a different location on the mounting surface, or to different mounting surfaces, such that the inner member may be removably secured between the first and second portions of any of the at least two folding members interchangeably.

11. A removable pouch assembly, comprising:

a pouch, further comprising:

a closeable opening that provides access to an inner volume thereof; and a plurality of pouch attachment points coupled to an exterior surface of the pouch, wherein two of the plurality of pouch attachment points are made of an electrically-conductive material and extend through the pouch to the inner volume thereof;

a connector assembly, further comprising:

a folding member, further comprising:

a first portion having a plurality of apertures therethrough, the apertures being equal in number to the plurality of pouch attachment points of the pouch; and a second portion foldably coupled to the first portion along an edge thereof, the second portion having at least one mounting attachment point coupled thereto, the at least one mounting attachment point being configured to secure the folding member to a mounting surface, wherein the first portion is releasably secured in a folded configuration to the second portion by a releasably securing means; and an inner member having a plurality of inner member attachment points coupled thereto, the inner member attachment points being equal in number to the plurality of pouch attachment points of the pouch, wherein two of the plurality of inner member attachment points are made of electrically-conductive material and are coupled together by an electrically-conductive material, wherein the inner member is removably secured between the first portion and the second portion while in a folded configuration such that each of the inner member attachment points corresponds to and extends through an aperture of the first portion and is removably coupled to the corresponding pouch attachment point of the pouch, respectively, wherein each of the electrically-conductive inner member attachment points is removably coupled to a corresponding electrically-conductive pouch attachment point of the pouch, respectively; and a light assembly, further comprising:

a flexible housing;

a power source coupled within the housing;

at least one light source coupled to the housing, the at least one light source being electrically coupled to the power source;

a first electrically-conductive attachment member coupled to the housing, the first electrically-conductive attachment member being electrically coupled to the at least one light source; and a second electrically-conductive attachment member coupled to the housing, the second electrically-conductive attachment member being electrically coupled to the power source, wherein each of the first and second electrically-conductive attachment member is coupled to an electrically-conductive pouch attachment point within the inner volume of the pouch, respectively, thereby completing an electrical circuit illuminating the at least one light source.

12. The removable pouch assembly of claim 11, wherein the at least one attachment point of the second portion of the folding member of the connector assembly is coupled to a surface of one of a purse, a bag, a case, or a pack.

13. The removable pouch assembly of claim 11, wherein the releasably securing means by which the first portion of the folding member of the connector assembly is releasably secured in a folded configuration to the second portion of the folding member of the connector assembly is a hook-and-loop fastener.

14. The removable pouch assembly of claim 11, wherein each of the plurality of pouch attachment points of the pouch, the plurality of inner member attachment points of the connector assembly, and the first and second electrically-conductive attachment member of the light assembly, is a snap fastener.

15. The removable pouch assembly of claim 11, wherein the first and second electrically-conductive attachment member of the light assembly is configured to be removably coupled together by a user, while the light assembly is detached from the pouch, thereby completing an electrical circuit illuminating the at least one light source.

16. The removable pouch assembly of claim 11, wherein the electrical circuit thereof further comprises a switch integrated therein for engaging and disengaging the electrical circuit.

17. The removable pouch assembly of claim 11, comprising at least two folding members, wherein each of the at least two folding members is coupled to a mounting surface at a different location on the mounting surface, or to different mounting surfaces, such that the inner member may be removably secured between the first and second portions of any of the at least two folding members interchangeably.

* * * * *